US006045036A

United States Patent [19]

Ring

[11] Patent Number: 6,045,036

[45] Date of Patent: Apr. 4, 2000

[54] COMPOSITE CONTAINER

[75] Inventor: Carl D. Ring, Oakland, Tenn.

[73] Assignee: Ring Can Corporation, Oakland, Tenn.

[21] Appl. No.: 09/233,203

[22] Filed: Jan. 20, 1999

[51] Int. Cl.[7] ..... B65D 5/462

[52] U.S. Cl. ..... 229/117.24; 220/23.86; 222/183; 229/117.13

[58] Field of Search ..... 229/117.09, 117.13, 229/117.24; 220/23.86, 23.91, FOR 112, FOR 120, FOR 122; 222/183, 465.1

[56] References Cited

U.S. PATENT DOCUMENTS

| | | | |
|---|---|---|---|
| 1,594,433 | 8/1926 | Towle . | |
| 3,119,544 | 1/1964 | Cope et al. . | |
| 3,160,326 | 12/1964 | Sturdevant et al. . | |
| 3,499,582 | 3/1970 | Berney . | |
| 4,133,428 | 1/1979 | Gloyer . | |
| 4,927,042 | 5/1990 | Ring | 222/183 |
| 5,340,000 | 8/1994 | Ring . | |
| 5,462,169 | 10/1995 | Dygert et al. . | |
| 5,497,899 | 3/1996 | Wuerfel | 229/117.13 |
| 5,765,711 | 6/1998 | Johnson et al. | 229/117.24 |

FOREIGN PATENT DOCUMENTS

| | | | |
|---|---|---|---|
| 8602958 | 6/1988 | Netherlands | 220/120 |

OTHER PUBLICATIONS

Prior Art Bottle.

*Primary Examiner*—Gary E. Elkins
*Attorney, Agent, or Firm*—David A. Tamburro

[57] ABSTRACT

A composite package including a thin-walled plastic bottle mounted within an outer paperboard box. The plastic bottle has a pouring spout adjacent its front wall and an L-shaped hollow handle including a horizontal leg extending rearwardly to a downwardly extending vertical leg which communicates with the chamber within the bottle. The top flap assembly of the box has an access means which permits the horizontal leg to be gripped while the package is being handled and transported. The rear wall of the box has an access means which permits the vertical leg of the handle to be gripped while liquid is being poured from the bottle.

3 Claims, 3 Drawing Sheets

COMPOSITE CONTAINER

BACKGROUND OF THE INVENTION

This invention relates generally to a composite container of the type which includes a thin-walled plastic bottle within a cardboard box, and more particularly to such a container wherein the handle of the bottle and the top and rear walls of the box are of novel cooperating configurations to facilitate gripping of the handle and pouring of liquid from the bottle.

Composite bottle-in-box (BIB) containers are used for packaging various liquids. In particular, the assignee of this application has sold a large 35 pound (5 gallon) container for edible oil commonly used in restaurants for deep frying food. Some customers have commented that the current BIB design is uncomfortable to hold while pouring and also exposes persons forearm to hot splashing oil when filling a deep fryer.

There is a need to alleviate the problems associated with the current design and the composite container of the invention addresses those problems.

SUMMARY OF THE INVENTION

Accordingly, a primary object of this invention is to provide a composite container including a thin-walled plastic bottle within an outer cardboard box, the handle of the bottle and the top and rear walls of the box being so configured so that a person may comfortably grip the handle while pouring edible oil into a deep fryer, with his forearm so positioned that it is protected from any hot splashing oil in the fryer.

The novel composite package of the invention achieves its objectives by providing an L-shaped handle having a horizontal leg extending rearwardly from the pouring spout toward the rear wall of the box and a vertical leg extending downwardly along the rear wall, the box having an access means in the top flap assembly which permits gripping of the horizontal leg of the handle to facilitate handling and transport of the composite package. The rear wall of the box also has access means either in the form of appropriate openings or as a removable panel adjacent the vertical leg of the handle so that the vertical leg of the handle may be conveniently and comfortably gripped as oil is poured from the spout of the bottle. Gripping the vertical leg of the L-shaped handle during the pouring operation safely positions the forearm of a person above and behind the package out of the way and protected from any hot oil splashing from a deep fryer.

Other objects and advantages of the invention will become apparent from reading the following detailed description of the invention wherein reference is made to the accompanying drawings.

DETAILED DESCRIPTION OF THE INVENTION

Figure 1:
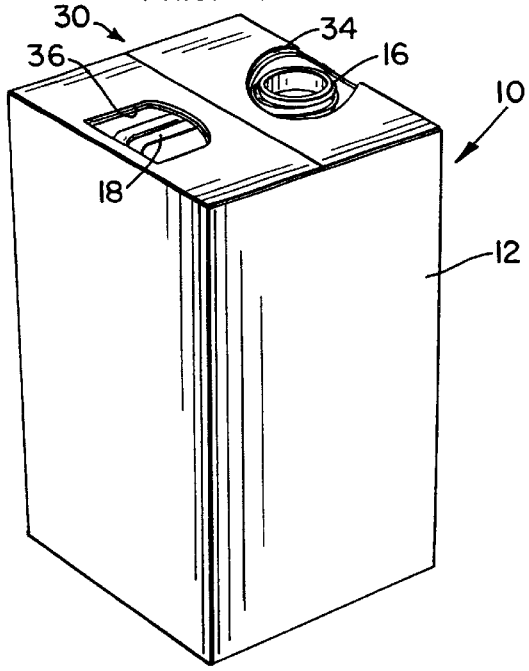
Fig.1 PRIOR ART
FIG. 1 is a generally perspective view of a prior art composite package design currently being sold by the assignee of this invention.
Figure 2:
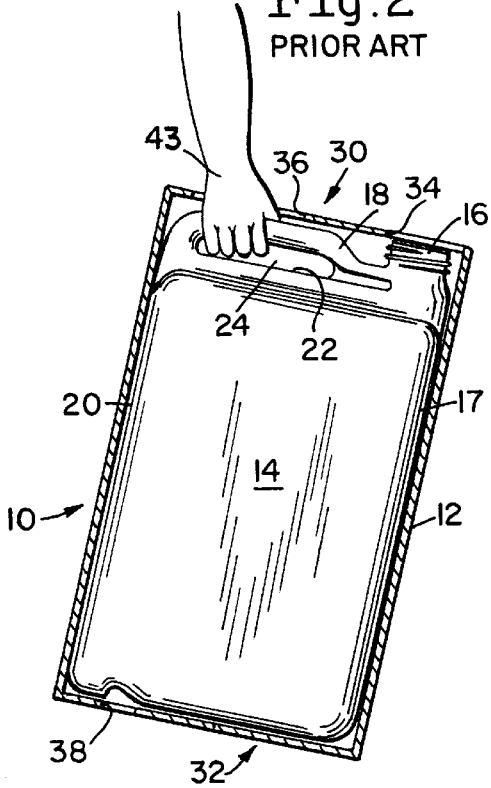
Fig.2 PRIOR ART
FIG. 2 is a fragmentary sectional view of the prior art package of FIG. 1 illustrating the manner in which the handle of the bottle may be gripped for handling and transport purposes.
Figure 3:
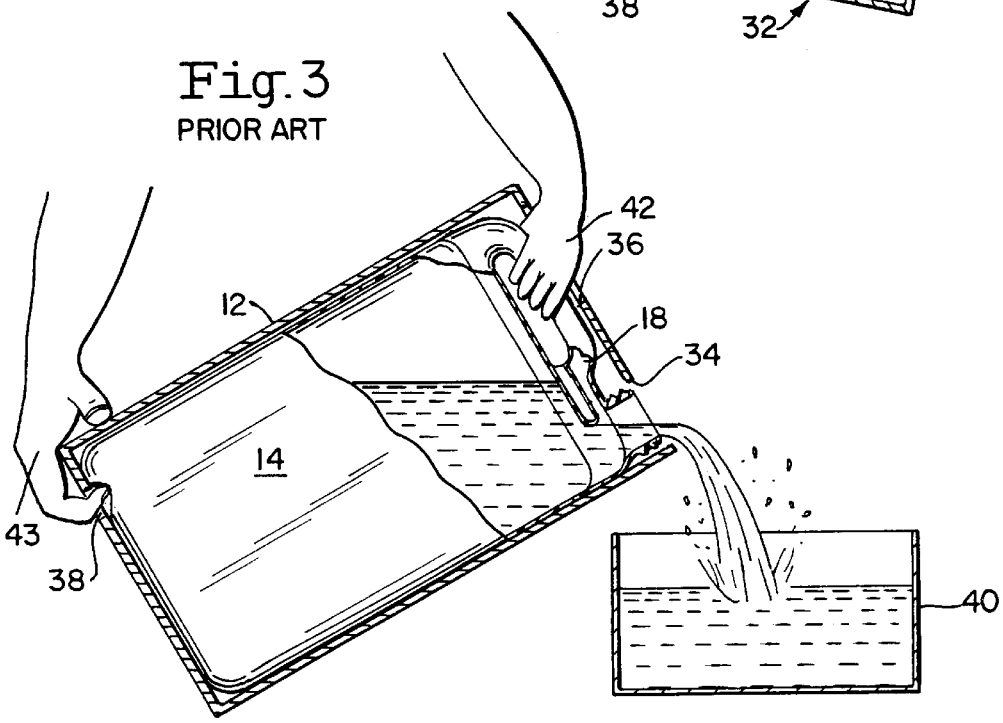
Fig.3 PRIOR ART
FIG. 3 is a fragmentary sectional view of the prior art bottle of FIGS. 1 and 2 illustrating the position of a person's hands and arms during a pouring operation.
Figure 4:
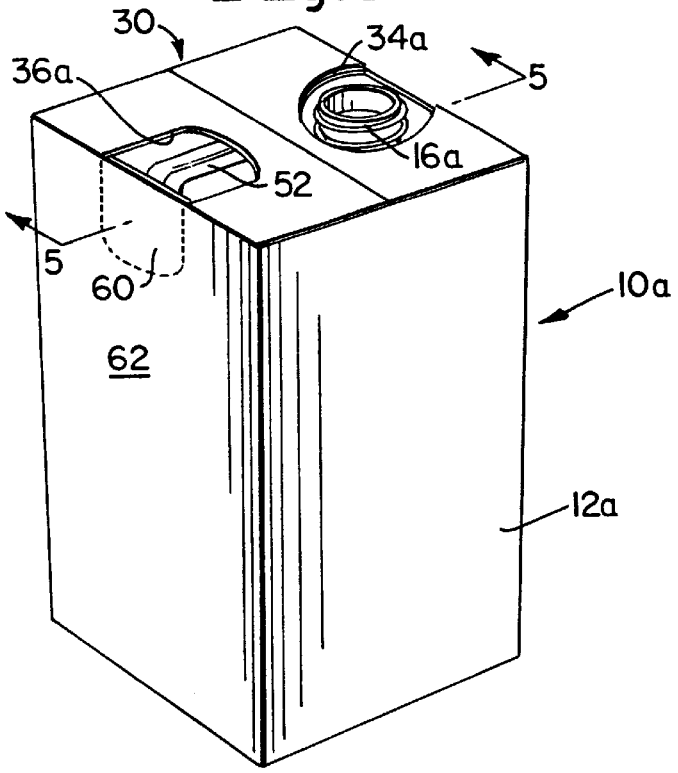
FIG. 4 is a generally perspective view of the novel composite package of the invention.

Referring to FIGS. 1, 2 and 3, the prior art composite package 10 includes an outer paperboard box 12 and an inner thin-walled plastic bottle 14 both of which are of generally square cross-sectional configuration. Bottle 14 is of the type generally illustrated in U.S. Pat. No. 5,340,000 and includes a pouring spout 16 centered on its front wall 17 and a hollow handle 18 extending horizontally rearwardly from spout 16 to rear wall 20, the handle 18 is spaced above horizontal top wall 22 to provide a horizontal finger receiving opening 24.

Box 12 includes foldable upper and lower flap assemblies 30 and 32 each formed by folded major front and rear flaps and minor side flaps. At the front of package 10, upper flap assembly 30 is provided with a cut out or opening 34 around spout 16 to permit pouring of liquid from the spout. At the rear of flap assembly 30, the flaps are provided with a cut out or opening 36 overlying the horizontal handle 18 to provide access to the handle.

As seen in FIG. 2, when the package is being handled or transported, a person may reach through opening 36, place his fingers through opening 24 and around handle 18 to firmly grip the bottle.

However, as shown in FIG. 3, when oil is to be poured from bottle 14 into hot splashing oil within a deep fryer 40 a person places his left hand 42 through opening 36 and grips handle 18, while the fingers of his right hand 43 are placed into an opening 38 in bottom flap assembly 32 as the package 12 is tilted horizontally to pour the oil into pan 40. The left hand 42 and the forearm are awkwardly twisted into an uncomfortable position, making it more difficult for the person to firmly hold the package. In addition, while the package is titled horizontally to its pouring position, the left hand and forearm are twisted forwardly toward fry pan 40 and become exposed to the splashes of hot oil from the fryer, potentially creating a dangerous burn situation.

To overcome those prior art problems, applicant has developed the novel composite package 50 of the invention illustrated in FIGS. 4–7. The package 50 is essentially identical to package 10 except for the configuration of the handle of the bottle and of the rear wall of the box adjacent to the handle. Thus, in FIGS. 4–7 identical elements are referred to with the same numerals followed by the suffix "a" and need not be described again.

Figure 5:
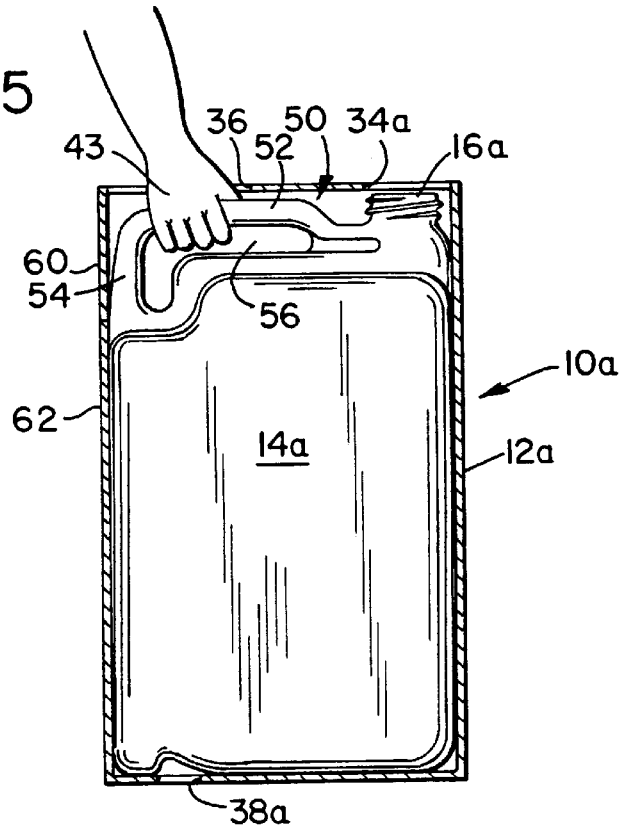
FIG. 5 is a fragmentary sectional view taken generally along line 5—5 of FIG. 4 illustrating the manner in which a person grips the handle of the bottle for distribution and transport purposes.

Bottle 14*a* includes a hollow, generally L-shaped handle 50 which includes a horizontal leg 52 centered between the sides of bottle 14*a* and extending rearwardly from spout 16*a* to a downwardly extending vertical leg 54 extending downwardly parallel to rear wall 62 of box 12*a,* the bottom end of leg 54 communicating with the open chamber within bottle 14*a.* Legs 52 and 54 define an L-shaped through opening 56 through which the fingers of a person's hand may be placed around horizontal leg 52 or vertical leg 54. As shown in FIG. 5, an access opening 36*a* in top flap assembly 30 permits a person to grip the horizontal leg 52 of handle 50 during a handling and transport situation.

To facilitate the pouring operation and overcome the problems associated with the prior art package of FIG. 1, box 12*a* includes an access means such as a removable perforated panel 60 at the upper end of its rear wall 62 immediately behind and adjacent the vertical leg 54 of handle 50.

Figure 6:
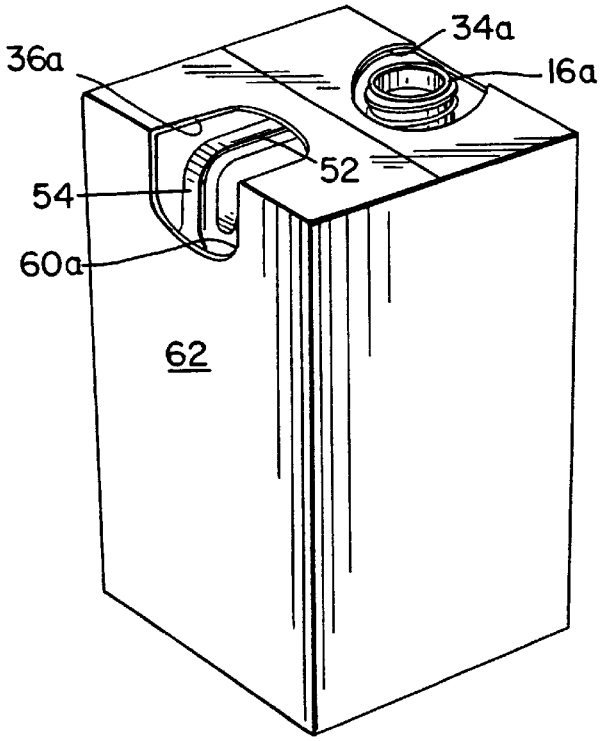
FIG. 6 is a fragmentary view similar to FIG. 4 but with the panel on the rear wall removed to provide access to the vertical leg of the handle of the bottle.
Figure 7:
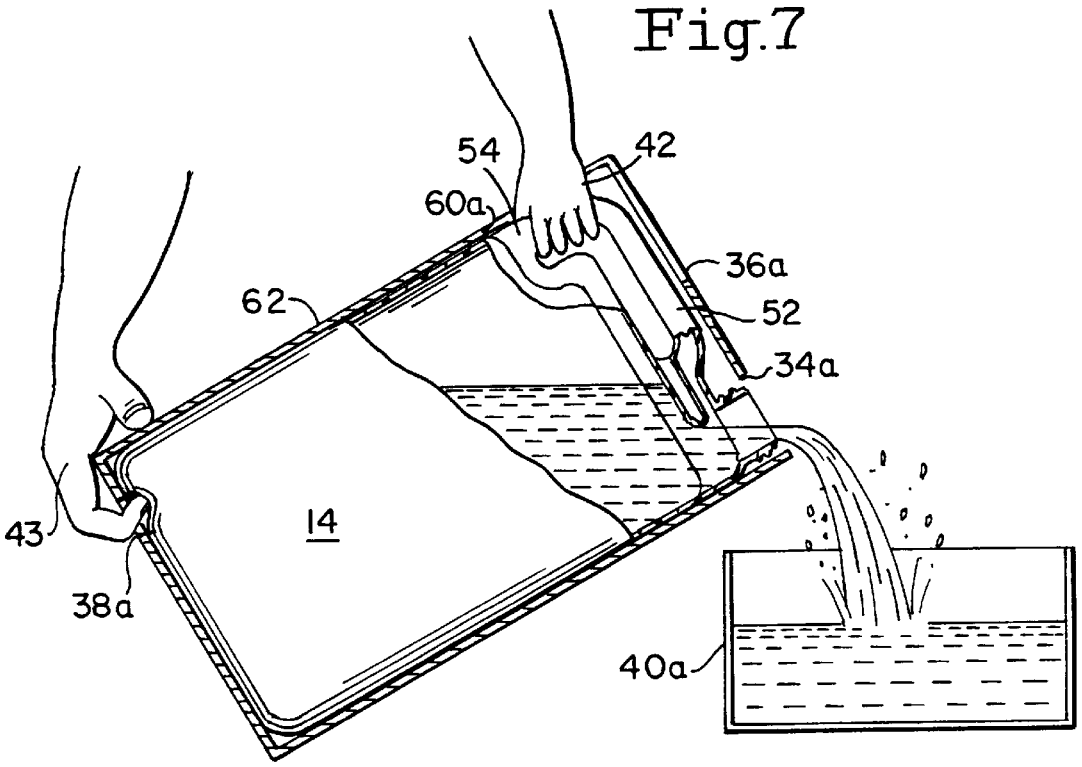
FIG. 7 is a fragmentary schematic view of the novel package of FIG. 4 illustrating the manner in which the vertical leg of the handle is gripped and the arms are positioned when pouring liquid from the package of the invention.

When oil is to be poured from spout 16, perforated panel 60 is removed as shown in FIG. 6, and as shown in FIG. 7 a person places his left hand through the rear opening 60*a* provided by the separated panel to grip vertical leg 54 as the package is tilted horizontally to pour oil into the fryer 40*a*. As can be seen in FIG. 7, the person's left hand 42 comfortably and securely grips the vertical leg 54 of the handle 50, the wrist is not twisted, and the forearm is not exposed to hot splashing oil from pan 40*a*.

The removable perforated access panel 60 firmly remains in place while the package is in the manufacturing and distribution systems to strengthen the box and to help keep the inner plastic bottle clean. The package can still be lifted and handled through the top opening 36*a* as illustrated in FIG. 5. When oil is to be poured from the package, panel 60 is removed to provide the access opening 60*a* and the pouring operation is accomplished as shown in FIG. 7.

While the access means is illustrated as a perforated panel 60, obviously if acceptable the panel may be replaced by a through opening or some other equivalent design which provides access to the vertical leg 54.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

I claim:

1. A composite package comprising:

an outer rectangular paperboard box and a thin-walled rectangular plastic bottle mounted within said box;

said bottle having a bottom wall, vertical front, rear, and first and second side walls extending upwardly from said bottom wall, the top wall extending across said vertical walls and defining a fluid containing chamber therewith, a pouring spout formed on said top wall adjacent said front wall, a generally L-shaped handle formed on said top wall and including generally horizontal and vertical legs extending between said spout and said rear wall;

said paperboard box including front, rear, and first and second side walls adjacent the front, rear, and first and second side walls, respectively, of said bottle, said box having a top flap assembly including first access means overlying said horizontal leg of said handle so that the horizontal leg may be gripped during normal handling of the package, and second access means on said rear wall of said box to provide access to said vertical leg of said handle so that said vertical leg may be comfortably gripped as fluid is poured from said bottle.

2. The composite package of claim 1, wherein said second access means comprises a removable panel section which is retained in place on said rear wall during normal handling of the package but is removed to provide access to said vertical leg when fluid is to be poured from said bottle.

3. The composite package of claim 1, wherein said L-shaped handle is hollow and is in fluid communication between said spout and said fluid containing chamber.

* * * * *